US005123571A

United States Patent [19]

Rebeyrolle et al.

[11] Patent Number: 5,123,571

[45] Date of Patent: Jun. 23, 1992

[54] PROCESS FOR THE PRODUCTION AND PACKAGING OF A BAG-TYPE DISPENSER, SUB-ASSEMBLIES AND CORRESPONDING DISPENSERS

[75] Inventors: Michel Rebeyrolle; Bernard Schneider, both of Sainte-Ménéhould, France

[73] Assignee: Cebal, Clichy, France

[21] Appl. No.: 728,535

[22] Filed: Jul. 11, 1991

Related U.S. Application Data

[62] Division of Ser. No. 384,430, Jul. 25, 1989, Pat. No. 5,031,384.

[30] Foreign Application Priority Data

Jul. 25, 1988 [FR] France ..... 88 10228
Dec. 23, 1988 [FR] France ..... 88 17625

[51] Int. Cl.[5] ..... B65D 35/56

[52] U.S. Cl. ..... 222/105; 220/410; 220/613; 222/183; 222/321

[58] Field of Search ..... 222/94, 95, 105, 183, 222/386.5, 387, 389, 394, 402.1, 635, 321, 383, 385; 220/403, 404, 410, 611, 613; 215/11.3, 12.1

[56] References Cited

U.S. PATENT DOCUMENTS 3,169,670 2/1965 Hrebenak et al. ..... 222/387 X
3,905,517 9/1975 Friedrich et al. ..... 222/95
4,008,830 2/1977 Meshberg ..... 222/95
4,045,860 9/1977 Winkler ..... 222/394 X
4,189,069 2/1980 Stoody ..... 222/94 X
4,322,020 3/1982 Stone ..... 222/321 X
4,356,926 11/1982 Priestly et al. ..... 220/613 X
4,457,455 7/1984 Meshberg ..... 222/383 X
4,671,428 6/1987 Spatz ..... 222/105
5,004,123 4/1991 Stoody ..... 222/321 X
5,076,470 12/1991 Hatakeyama et al. ..... 222/94

*Primary Examiner*—Michael S. Huppert
*Assistant Examiner*—Joseph A. Kaufman
*Attorney, Agent, or Firm*—Dennison, Meserole, Pollack & Scheiner

[57] ABSTRACT

A bag-type dispenser comprising a casing including a tubular body and a separate body portion, a tubular skirt, a dispensing portion and a one-piece molded annular dome of plastic material including an upper annular portion fixed to the dispensing portion, a lower tubular portion directly and sealingly fixed to the tubular skirt at an upper portion of the skirt over a height of 5 to 20 mm, and a lower annular portion outside the lower tubular portion, directly and sealingly fixed to the tubular body at an upper end. The dispenser can be filled with product by way of a lower end of the tubular skirt which is open, and which can subsequently be closed to form a bag.

11 Claims, 6 Drawing Sheets

Figure 1:
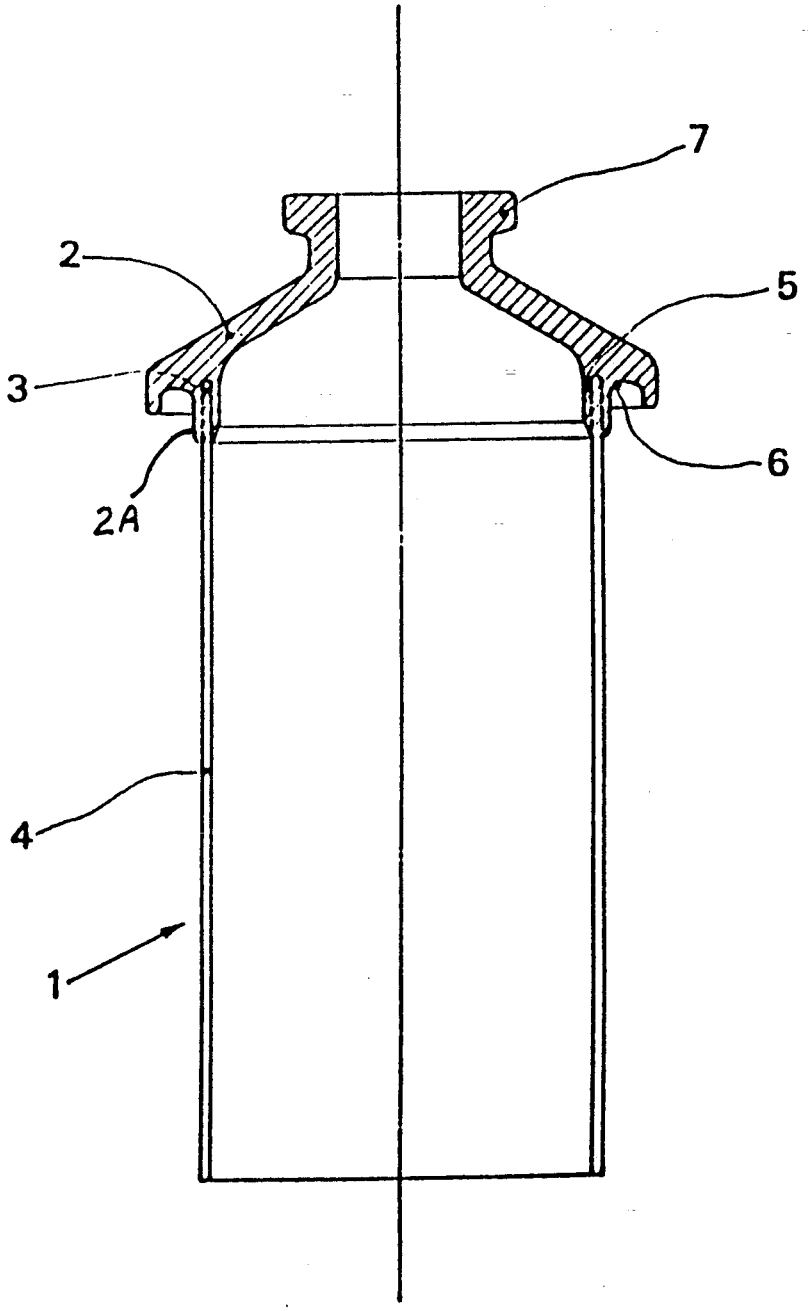

PROCESS FOR THE PRODUCTION AND PACKAGING OF A BAG-TYPE DISPENSER, SUB-ASSEMBLIES AND CORRESPONDING DISPENSERS

"This is a divisional of application Ser. No. 07/384,430, filed Jul. 25, 1989 now U.S. Pat. No. 5,031,384."

The invention concerns a bag-type dispenser and a process for the production and packaging thereof. A bag-type dispenser of that kind is used for cosmetic, pharmaceutical, hygiene or foodstuff products.

FR-A-2 310 827 corresponding to U.S. Pat. No. 4,045,860 describes a container of aerosol type with two chambers or of "bag type" wherein, in order to produce a perfect seal at the location at which the bag is fixed to the external container or casing, an annular seal is set in position between the rolled edge of the dome of the casing and the collar portion of the bag, the collar portion being disengaged from the casing by an extractor and then the extractor itself being disengaged from the bag. The fixing cap of the dispensing valve is then set in position on the upper rim of the casing and the peripheral collar of the cap is crimped around the rolled edge, whereby the annular seal is gripped between the rolled edge and the collar portion of the bag on the one hand and the collar of the valve fixing cap on the other hand. The assembly operations which conclude with the crimping operation are thus delicate and relatively complex.

The applicants sought to develop a production process in which the assembly operations are simplified, in particular those which follow the production of the casing.

STATEMENT OF THE PROBLEM

The invention concerns a process for the production and packaging of a bag-type dispenser comprising a casing surmounted by a dome, a sealed flexible bag fixed to the interior of said casing and dispensing means sealingly connected to said dome and to said bag. According to the invention, before any other assembly and packaging operation, a dome of plastics material is produced by moulding, the dome comprising an internal tubular portion permitting sealing fixing thereof onto the upper end of a skirt forming the blank of the bag, and then said fixing is produced, thus providing a preassembled component (dome+skirt), the dome further comprising portions for fixing thereof respectively to the upper end of the casing and to the dispensing means. The bag-blank skirt is thus sealingly fixed to a dome which will connect the casing to the dispensing means, instead of being fixed to the casing as in the prior art.

In this description the vertical direction is by convention the direction of the longitudinal axis of the casing and the skirt or bag and the top of the dispenser or the component parts thereof corresponds to the end of the dispenser which carries the dispensing means.

The preassembled component (dome+skirt) has important advantages:

- the shaping and assembly operations are facilitated;
- the problem of making a seal between the bag and the upper edge of the casing is simplified;
- the component (dome+skirt) can be sealingly fixed either firstly to the upper end of the casing or firstly to the dispensing means, which permits the bag to be filled by way of the top or by way of the bottom;
- the axis of the upper opening of the dome and therefore the direction in which the product is dispensed can be oriented in various ways by simply changing the geometry of the dome;
- the production process can be adapted to varying types of dispensers:
  - having a metal casing, with a dispensing valve and a propellent gas between the bag and the casing;
  - or having a metal casing or a casing of plastics or metalloplastic material, with a dispensing pump with low or zero intake of air, the bag then being subjected to atmospheric pressure; and
- as will be seen, the methods of fixing the component (dome+skirt) are varied and simple and reliable from the industrial point of view, and the choice thereof makes it possible to carry out the production process with various types of equipment.

The operation of sealingly fixing the internal tubular portion of the dome onto the upper end of the bag-blank skirt is effected either by means of a clamping ring or an elastic band clamping the skirt around the tubular portion, possibly in an annular groove in the tubular portion, which construction can be used for short production runs, or preferably, for long production runs, by moulding in the operation of moulding the dome, or by glueing the end of the skirt around said tubular portion.

When the component (dome+skirt) is directly produced by moulding, a portion of the tubular skirt is fitted around a punch in such a way that its upper end projects beyond the punch by a selected length. The skirt is then contained between the punch and the die tools which, with said projecting end, with a tool which is internal to the punch and with die bottom tools, define an annular space which is fed with plastics material, typically by means of at least two lateral or inclined injection ducts.

The annular moulding space which is defined in that way is of a cross section corresponding to the profile of the dome portion to be produced, and makes it possible to remove from the mould the desired component (dome+skirt). The skirt is connected to the dome portion of that component by an internal tubular portion which is suitable for being mounted in the neck of the casing.

The upper end of the skirt which is fitted into the tubular portion by the moulding operation can thus be disposed: either flush with the internal surface of the tubular portion, or in the thickness of said tubular portion and preferably closer to the external surface of the internal tubular portion of the dome than its internal surface, or, even more advantageously in regard to the operation of moulding the dome onto the skirt, at the external surface of said tubular portion. Experience has also shown that the sleeve or sheath, which was usually very thin, being for example 0.2 to 0.3 mm in thickness, had a tendency, once used as a bag, to close up at the end of an emptying operation due to a twisting or kinking effect, that situation arising when the top end of the bag was welded to the tubular portion of the dome over only 3 to 4 mm. That disadvantage is avoided and more complete emptying of the bag when finishing dispensing of the product is attained by taking a higher internal tubular portion of the dome and carrying out the moulding operation in such a way that the end of the bag is contained in the thickness of the dome, that is to say typically its internal tubular portion, or connected to that tubular portion, over from 5 to 20 mm in height, with the optimum dimension being from 8 to 15 mm.

When the upper end of the sealing skirt is glued around the internal tubular portion of the dome, it is preferably for one of the two surfaces to be glued to be subjected to surface oxidation beforehand, typically by a flame process or a corona effect. When the internal surface of the skirt is of PE, it must thus be subjected to surface oxidation in order to achieve good adhesion for the glue. It is necessary to ensure that the glue which is then usually applied to the tubular portion is not completely scraped off by the operation of introducing the skirt. A first solution is to leave a slight clearance between the skirt and the tubular portion, with the internal diameter of the skirt being about 0.2 to 0.3 mm larger than the external diameter of the tubular portion so as to leave a film of glue.

A second and better solution is to have one or more annular recessed zones for retaining glue on the surface of the tubular portion of the dome which is to be stuck, the zones being of a depth of less than 0.15 mm in order to facilitate the operation of removing the moulded dome from the mould, that configuration preferably being used in conjunction with the skirt being lightly clamped around the tubular portion. When the arrangement has a plurality of annular zones, with the optimum dimensions involving a height or width of between 0.5 and 2.5 mm and a depth of between 0.04 and 0.1 mm, they are advantageously connected together by recessed passages or bridging portions of an equal or similar depth so as to improve the distribution of the glue at the time at which the skirt is fitted therearound. In order to permit more convenient and securer glueing, the annular zones may also be preceded by an end portion bearing an upwardly inclined flexible annular lip serving as a reserve of glue, the bottom of the reserve being connected to the most closely adjacent recessed annular zone, that is to say the first recessed annular zone starting from the end of the tube portion, by way of recessed bridging portions. The operation of fitting the skirt around the tubular portion then squeezes down the flexible lip, expelling glue towards the recessed annular zone or zones, that glue being propagated by way of the recessed bridging portions.

The glueing tests which were carried out showed that cyanoacrylate glues were particularly suitable for industrial protection, the annular dome preferably being made of polyamide, polyacetal or polycarbonate for rigidity thereof while the skirt being made at least at its internal surface of PE (polyethylene). Once the component (dome+skirt) has been produced, the production sequences may vary substantially, the operations then being distributed as between the package manufacturer and the packager, in the way that suits them best.

In accordance with a first production procedure, the other assembly and packaging operations are carried out in the following order:

a) closing the lower end of the skirt of the component (dome+skirt), the skirt becoming a bag;
b) introducing said bag of the previous component which became (dome+bag) into the casing;
c) sealingly fixing said component by its dome portion to the upper end of the casing; and then, at the packagers:
d) effecting filling of the product to be dispensed by way of the top of the bag;
e) sealingly fixing to the top of the dome portion the dispensing means comprising either a valve or a pump with a low or zero intake of air; and
f) when the dispensing means comprise a valve, introducing gas under pressure between the bag and the casing.

In accordance with a second production procedure in which packaging and assembly are integrated, the other assembly and packaging operations are carried out in the following order:

$a_1$) sealingly fixing to the dome of the component (dome+skirt) the dispensing means comprising either a valve or a pump with a low or zero intake of air;
$b_1$) turning the resulting assembly over and filling the skirt which is closed by the dome and by said dispensing means with the product to be dispensed, by way of the lower end of the skirt which is disposed in the upward position;
$c_1$) closing said end of the skirt which becomes a bag;
$d_1$) introducing the filled bag of the new assembly produced (dome+bag+dispensing means) into the casing;
$e_1$) sealingly fixing that new assembly by way of its dome portion to the upper end of the casing;
$f_1$) when the dispensing means comprise a valve, introducing a gas under pressure between the bag and the casing.

In the case where the dispensing means then comprise a pump with a low or zero intake of air, provided with an annular fixing rim at least externally of plastics material, it is advantageous in a mass production situation to carry out the operation of fixing the pump to the dome—that is to say operation $a_1$)—at the same time as the operation of fixing the skirt or dome by moulding. The direct moulding procedure already described above in regard to the component (dome+skirt) is modified in that the annular mould cavity defining the dome contains the periphery of the annular rim of the pump. The tools containing the pump and protecting it from the heating effect of the moulding operation are a lower tool with a central cavity which is surmounted by a rim sealingly supporting said rim, and a die bottom tool which caps the pump and which bears against the rim, completing the sealing effect with respect to the molten plastics material. The connection produced between the dome and the rim of the pump is either a weld if the plastics materials in question are of the same nature, or a glueing effect with intimate adhesion, without refusion, which however provides a good sealing effect, as has been verified, when the plastics materials are dissimilar, for example polypropylene for the ring of the pump and HD-PE for the dome. In order to improve the strength of the fixing and the reliability of the corresponding sealing effect, it is then desirable to provide the annular rim in the part thereof which is involved in the moulding with at least one fine circuilar rib or groove. Once the assembly of the dome+skirt+pump has been produced in that way, the procedure then continues with operations ($b_1$) to ($e_1$).

In accordance with a third production procedure and when using a metal casing comprising a separate tubular body and bottom, when for example both are of tin plate or possibly aluminium, the other assembly and packaging operations are carried out in the following order:

$a_2$) sealingly fixing to the dome of the component (dome+skirt) the dispensing means comprising either a valve or a pump with a low or zero intake of air;

$b_2$) introducing the skirt of the resulting assembly (skirt+dome+dispensing means) into the body of the casing;

$c_2$) sealingly fixing said assembly by means of its dome portion to the upper end of said casing body; and then at the packagers:

$d_2$) turning over the resulting complex assembly and filling the skirt which is closed by way of the dome and the dispensing means with the product to be dispensed, by way of the lower end of the skirt which is disposed in the upward position;

$e_2$) closing said end of the skirt which becomes a bag and if necessary putting that end back into the casing body;

$f_2$) crimping the metal bottom which is pierced with a hole over the open lower end of the metal body; and $g_2$) when the dispensing means comprise a valve, introducing a gas under pressure between the bag and the casing and closing the hole in the metal bottom.

As in the second production procedure, when the dispensing means comprise a pump with a low or zero intake of air bearing an annular fixing rim at least externally of plastics material, it is an attractive proposition firstly to produce a dome of plastics material which is moulded both onto the skirt forming the blank for the bag and around said fixing rim of the pump. After having produced an assembly (dome+skirt+pump) in that way, the procedure is continued with operations ($b_2$) and ($c_2$) and then usually at the packagers by the same operations ($d_2$) to ($g_2$).

It is possible to go further in the case of pre-assembly by moulding and directly to produce an assembly of (dome+skirt+pump+metal tubular body), which then replaces the elementary moulding (dome+skirt) and operations ($a_2$) to ($c_2$).

The moulding tools are then of the same type as those described in regard to the alternative form of the second production procedure, with the following modifications:

There is a double concentric punch for positioning of the skirt of the bag and the skirt of the tubular metal body and for removal of the moulded components from the mould, and the annular mould cavity surrounds a rolled edge prepared at the upper end of the metal tubular body, the connection of the dome being effected at that location by filling of the interior and the exterior of the rolled edge. The rolled or folded edge is not closed and can be tightened much less than a rolled edge for crimping, which is an advantage in terms of ease of production and flexibility.

The resulting complex assembly is then ready for packaging operations ($d_2$) to ($f_2$).

Besides the operations for moulding assemblies of components or "dispensing sub-assemblies" as already described above, different methods of fixing the component (dome+skirt) can be used and will be described in relation to the following examples and the drawings illustrating same. The mode of closure of the lower end to give a bag is important to facilitate the inward movement of the bag into the casing and will also be described.

The invention also concerns the preassembled component (dome+skirt) as well as the different assemblies or sub-assemblies produced.

EXAMPLES

Figure 2:
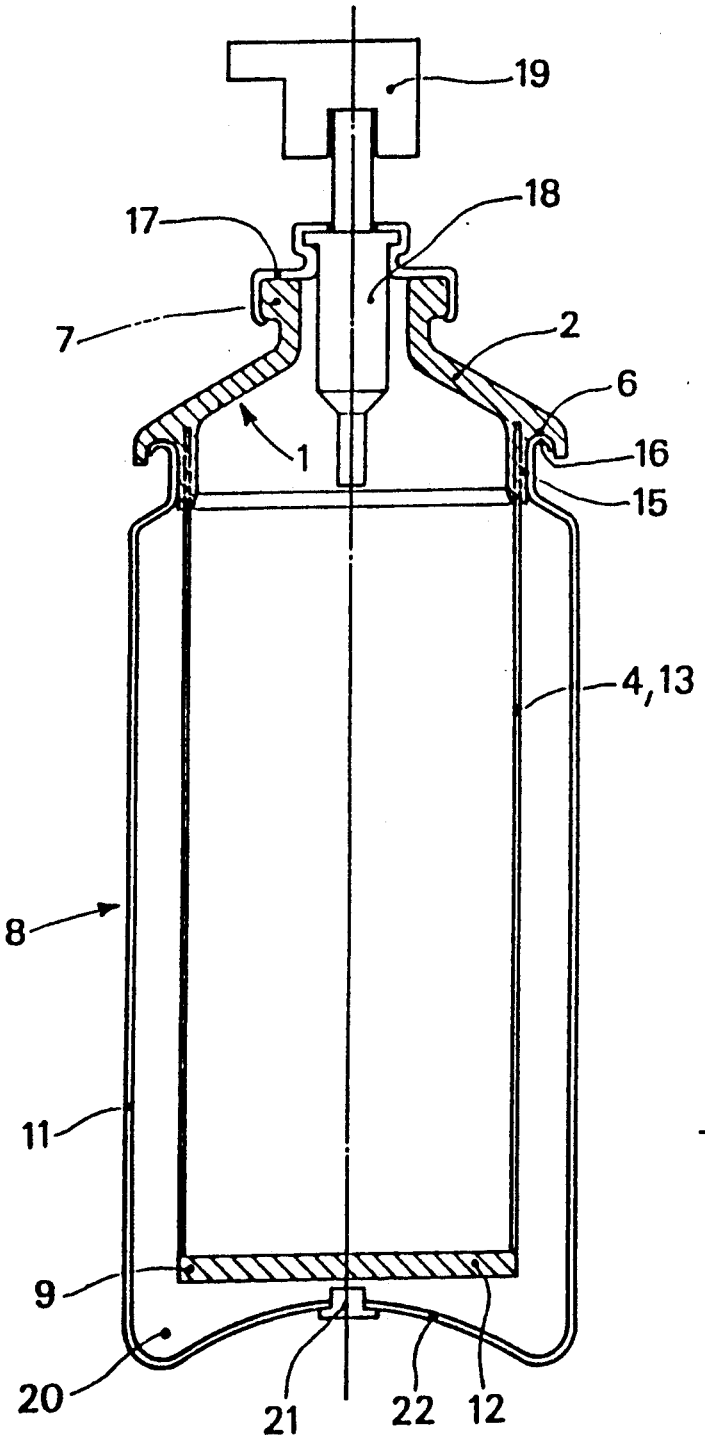
Figure 3:
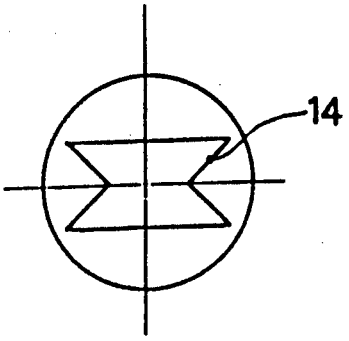
Figure 4:
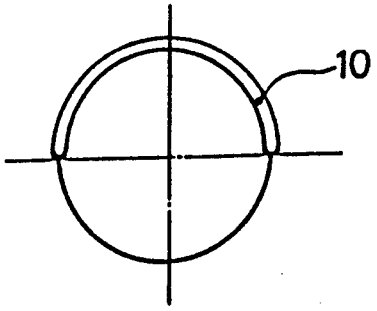
Figure 5:
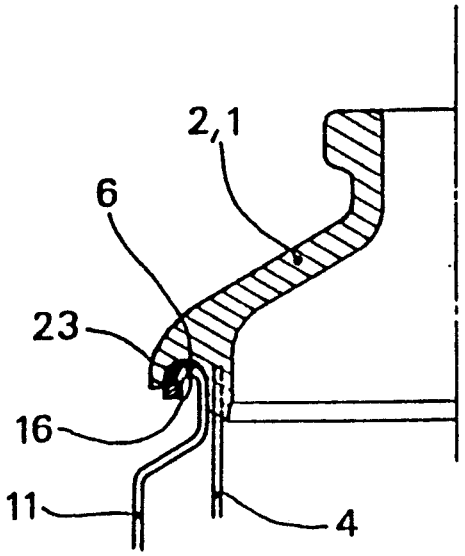
Figure 6:
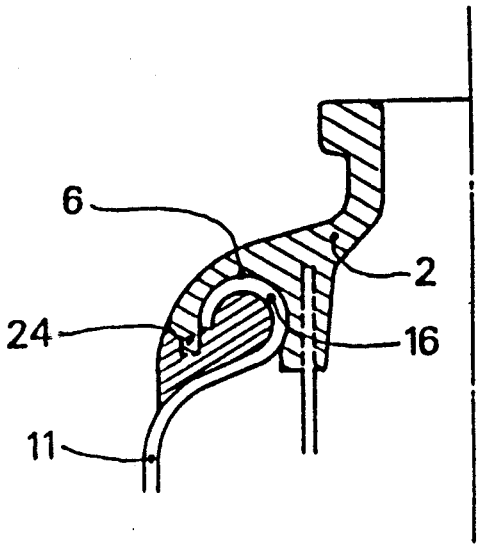
Figure 7:
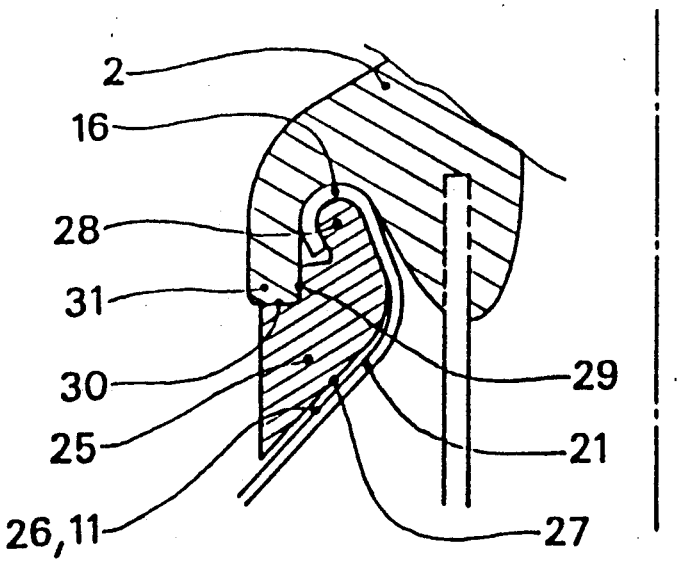
Figure 8:
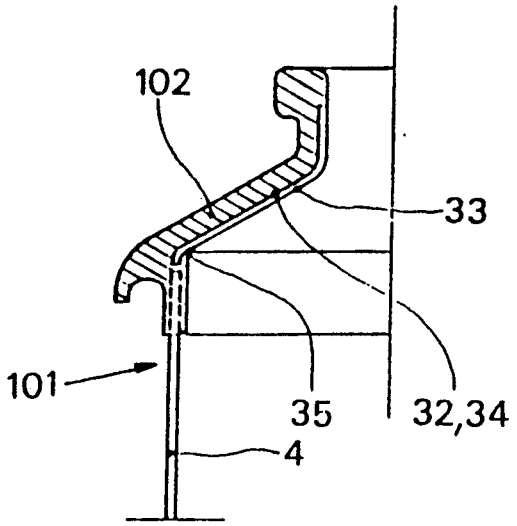
Figure 9:
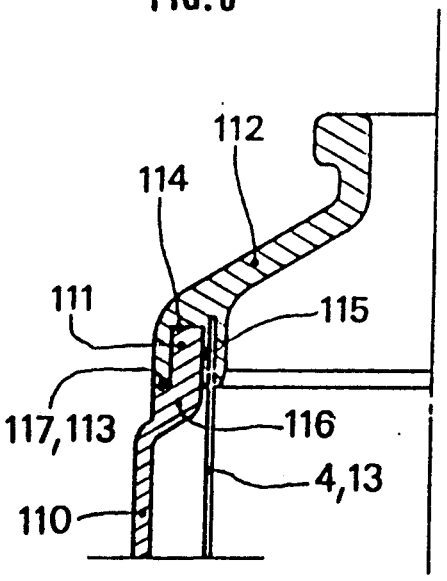
Figure 10:
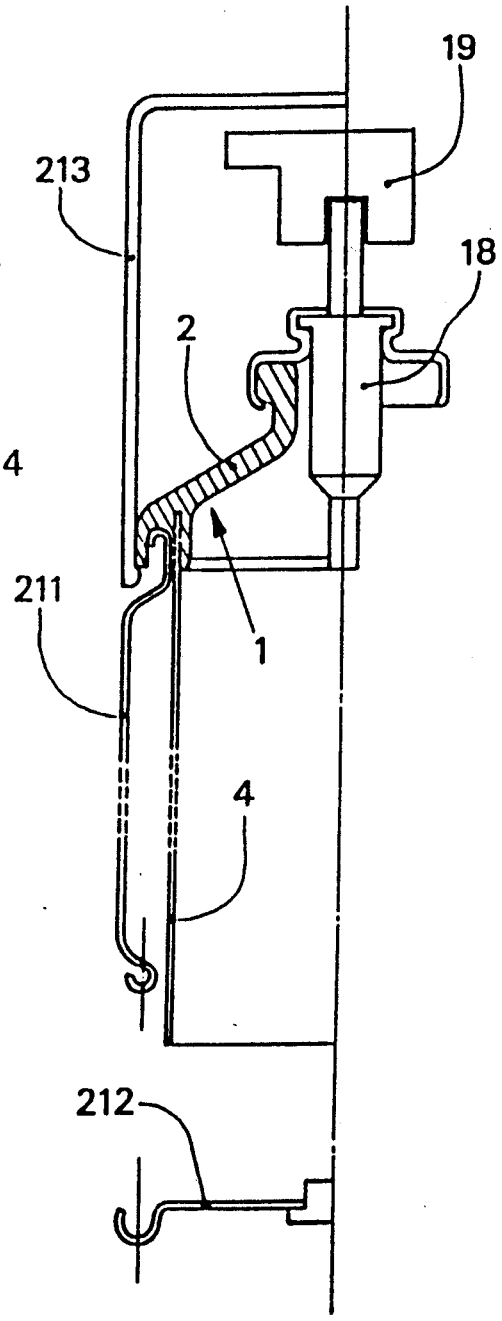
Figure 11:
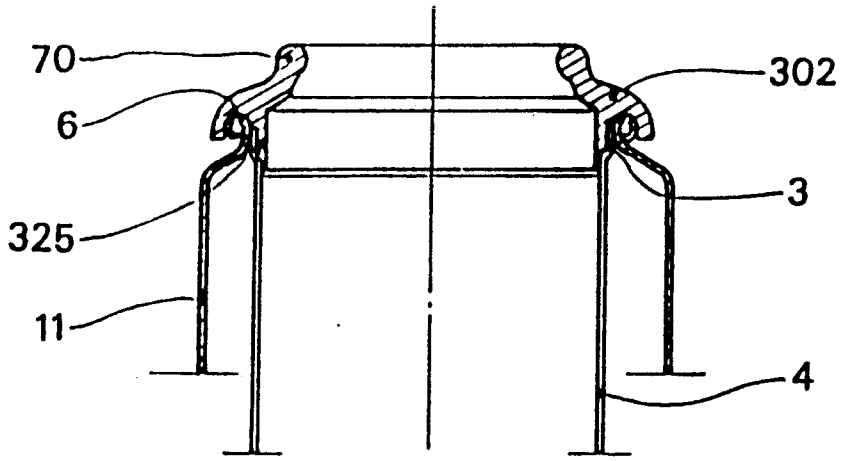
Figure 12:
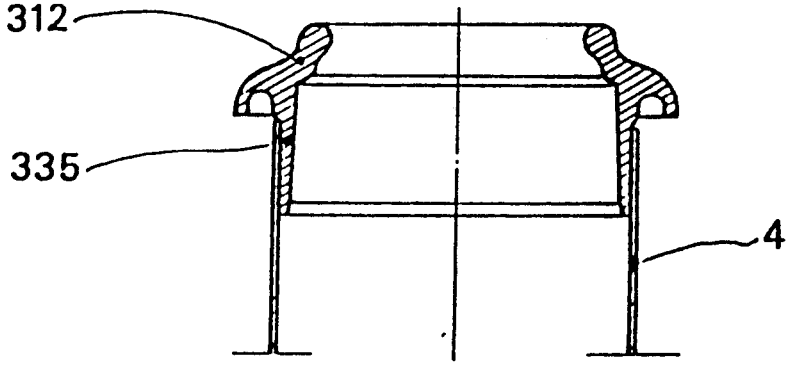
Figure 13:
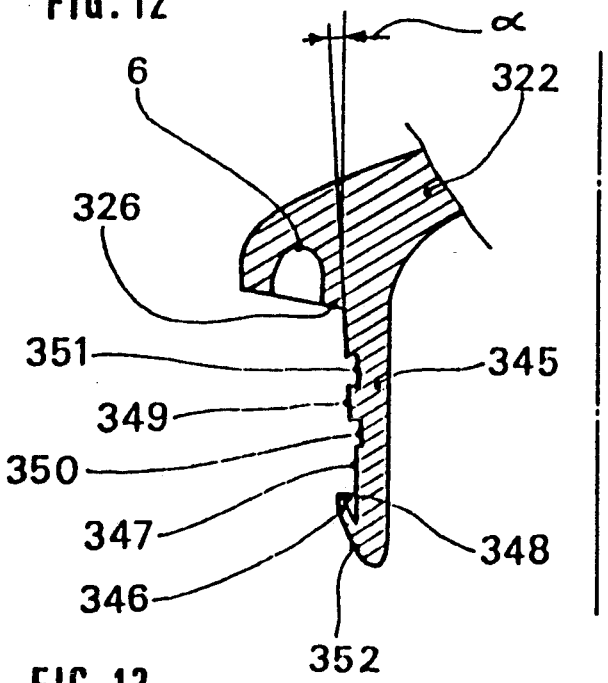
Figure 14:
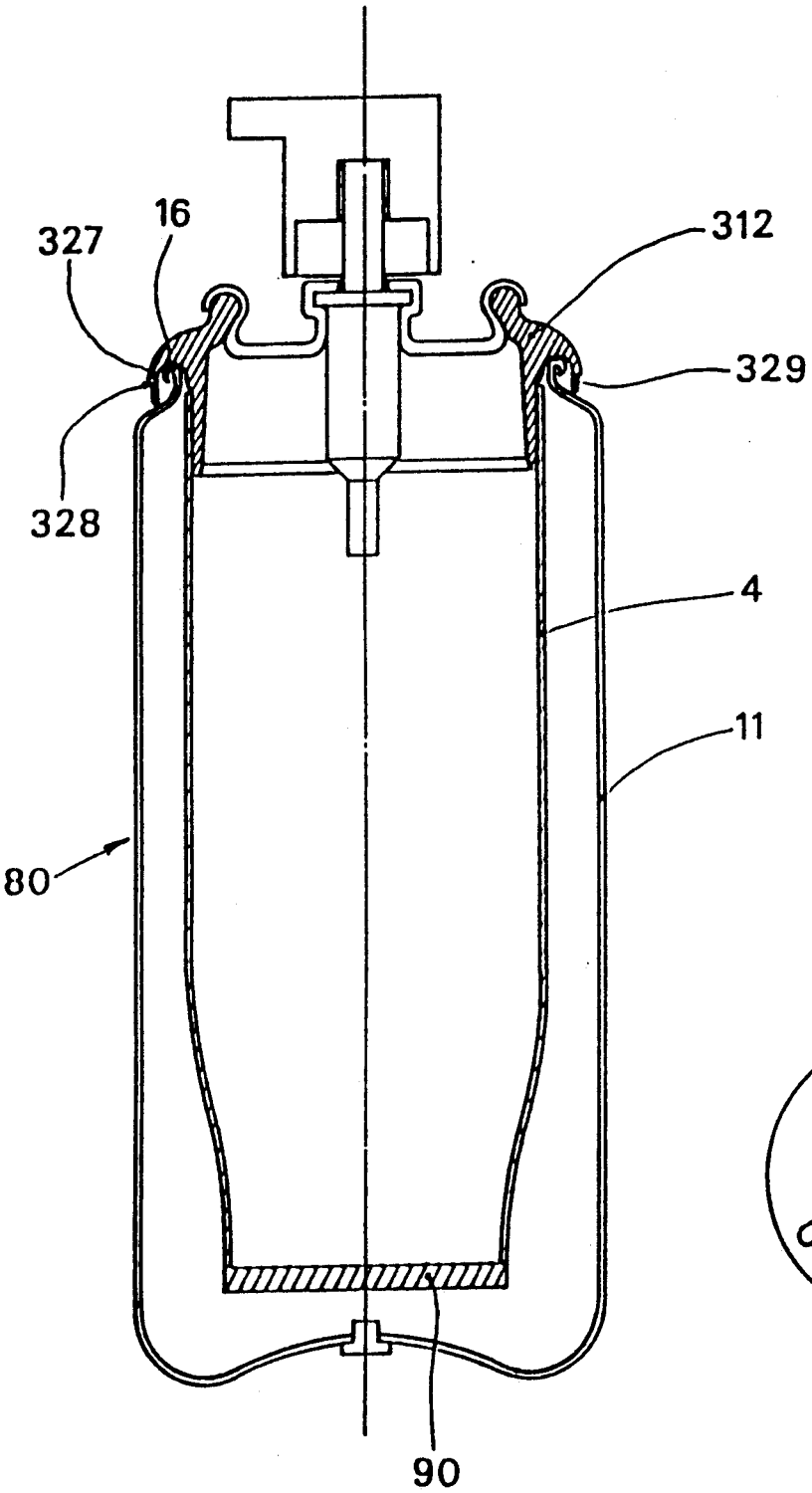
Figure 15:
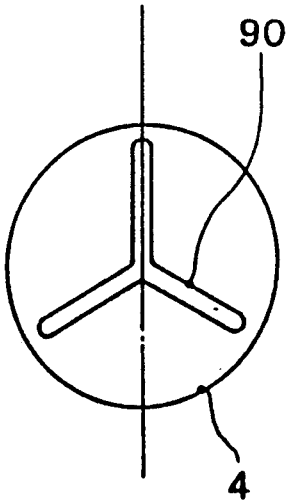

FIG. 1 is a view in axial section of a preassembled component (dome+skirt),

FIG. 2 is also a view in axial section of a dispenser produced from the FIG. 1 component (dome+skirt), FIGS. 3 and 4 show views in section perpendicular to the axis of the contours of two end closures of the skirt, FIGS. 5 to 7 are views in axial section of halves of different methods of sealingly connecting the dome and the upper end of a metal casing, FIG. 8 is a view in axial section of half of a component (dome+skirt) in which the dome is provided on its reverse face with an insert forming a barrier for scents, FIG. 9 is a view in axial section of half of the assembly of a component (dome+skirt) and the top end of a casing of plastics material, FIG. 10 is a view in axial section of part of a dispenser with a metal casing, the bottom of which is to be crimped, corresponding to the third production procedure described above, FIG. 11 is a view in axial section of an assembly of a component (dome+skirt) and the top end of a metal casing, the skirt and the dome being assembled by moulding, FIG. 12 is a view in axial section of a component (dome+skirt) which is assembled by glueing, FIG. 13 is a view in axial section of half of the internal tubular portion of a dome provided with means for distribution of the glue, FIG. 14 is a view in axial section of a dispenser obtained from the component (dome+skirt) shown in FIG. 12, and FIG. 15 is an end view of the contour of the weld in the form of a triangular star on the bag of the preceding dispenser.

EXAMPLE 1

The component (dome+skirt) in FIG. 1 comprises a dome 2 of high-density polyethylene (HD-PE) which is moulded at joint 2-A onto the upper end portion 3 of a metalloplastic skirt 4 of an external diameter of 35 mm and of a thickness of 0.28 mm, comprising 5 layers, formed by the following, starting from the outside and moving inwardly:

1 layer of white LD-PE (with the addition of titanium oxide powder) of a thickness of 90 μm;

1 layer of copolymer adhesive based on EAA, of a dimension of 30 μm;

1 layer of aluminium of a thickness of 40 μm;

1 further layer of the same adhesive, of a dimension of 30 μm; and 1 internal layer of MD-PE of a thickness of 90 μm.

The upper end 3 of the skirt 4 was trapped by the moulding operation in an internal tubular portion 5 of the dome 2, of an external diameter of 36.3 mm, over a height of 13 mm, its internal and external layers accordingly being partially re-melted and welded and the covering of plastics material on the dome being 0.8 mm on the outward side and 1.5 mm on the inward side. That arrangement provides the top of the skirt which is closed in a bag configuration with a sufficient degree of rigidity for the opening of the bag to remain in the last phases of dispensing of product therefrom.

The dome portion 2 comprises on the outside of its internal tubular portion 5 a semicircular groove 6 of a radius of 1.5 mm in axial section and with a mean diameter of 42 mm, the external diameter of the dome being 45 mm.

At its upper end the dome 2 comprises an external enlargement portion 7 of an external diameter of 20 mm, for crimping thereto of a metal valve or dispensing pump cap.

EXAMPLE 2

The component (dome+skirt) 1 was used to produce a bag-type dispenser (see FIG. 2) using the process of the first production procedure. The lower end 9 of the skirt 4 was closed by welding in an arc configuration, the end 9 being folded over in a doubled semicircular form as indicated at 10 in the diagrammatic view in FIG. 4 and pinched over a height of 6 mm by welding. That arrangement gives a welded end 12 of the bag 13, of a curved configuration but of the same diameter as the skirt 4 and which does not involve any difficulty in introducing same into the casing 11. After welding, the weld 12 was cropped by about 2 mm, thus removing its excess length at its external unwelded end.

FIG. 3 shows in the same fashion as FIG. 4 another mode of folding the end of the skirt, referred to as a "bellows" configuration as indicated at 14, which provides the same advantage that the end of the bag is not enlarged, the end then being closed by glueing or by welding, the latter being a more delicate operation than in the case of welding in an arc configuration.

The casing 11 of the dispenser 8 isof aluminium, with the thickness of the cylindrical body being 0.35 mm, with an opening or throat 15 of an internal diameter of 36.5 mm, above which is disposed an edge 16 which is rolled over about 150°, with an external radius of 1.3 mm. The operation of fixing the dome 2 to the rolled edge 16, after closure of the bag 13 and the introduction thereof into the casing 11, was effected by surface oxidation of the circular groove 6 in the dome 2 (corona treatment) and glueing using cyanoacrylic glue of the groove 6 which is fitted over the rolled edge 16, with the assembly being held together for a little more than 1 minute while the glue dries.

Other known methods for surface treatment of the groove of plastics material may be employed, for example a treatment using a flame or with a shaping electrode (corona effect).

The metal fixing cap 17 of a dispensing means 18, which in this case is capped by a diffuser pushbutton 19, is crimped with a sealing member beneath the enlargement portion 7 on the upper end of the dome 2. When the dispensing means 18 is a valve for discharge of the product in question, the annular gap 20 between the casing 11 and the bag 13 is filled with a gas under pressure and the sealed plug 21 is then back into position. When the means 18 is a pump without intake of air, there is no need for propellent gas and it is sufficient for the exterior of the bag 13 to be communicated with atmospheric pressure, which simplifies the packaging operation. In the present case, the plug 21 is eliminated and the bottom 22 of the casing which is provided with some orifice for the flow of air therethrough now only plays the part of providing protection for the bag, without being necessary for performing the dispensing operation.

EXAMPLE 3

The operation of fixing the dome 2 of the prefabricated component (dome+skirt) 1 to the casing is typically effected by the packaging manufacturer. Various methods can be used in mass production situations. The methods which involve metal casings, typically of aluminium or of tin plate of from 0.2 mm to 0.6 mm in thickness, the dispensers being pressurized or unpressurized, as has already been indicated above, are referred to hereinafter in relation to FIGS. 5 to 7.

FIG. 5 shows the fixing of a dome 2 provided with a skirt 4 of the same geometry as in the first two examples onto a casing 11 which is identical to the casing in FIG. 2 by means of an annular connecting member 23 compatible both with the plastics material of the dome 2—in this case HD—PE—and the metal of the casing 11—in this case aluminium. The moulded component 23 which is 0.2 mm in thickness is of a complex material containing the same polyolefin as that of the dome 2, that is to say PE, and EAA; its external edge is clipped over the end of the rolled edge 16 and, after the component 1 has been set in position, with the dome 2 being applied to the connecting member 23 by way of its circular groove 6, the welding operation is carried out using one of the following methods: high frequency induction, rotation or ultrasonic, while modifying the form of the dome for the ultrasonic transducer to bear thereagainst.

It will be seen from FIG. 6 that the dome 2 which is set in position by way of its circular groove 6 over the rolled edge 16 of the casing 11 has an end portion of the circular groove 6, which projects by about 1 mm beyond the end of the rolled edge 16, without obstructing the interior of the rolled edge 16. By annular injection of plastics material of the same nature as that of the dome, in this case PE, the internal cavity of the rolled edge 16 is at least partially filled by partially melting the external lip 24 of the dome which borders the end portion of the circular groove 6, the lip 24 being 1 mm in thickness at that location. That produces a sealed welded connection of high quality. Generally speaking the end portion 24 of the dome 2 which is thus secured in position by the moulding operation must be disposed in the vicinity of the end of the rolled edge, that is to say less than 0.5 mm in front of that end or a little further, leaving at least 1 mm clearance towards the interior of the rolled edge 16.

The fixing method used in FIG. 7 uses an annular shaped component 25 of plastics material of the same nature as that of the dome 2, the top of which is not shown, the component 25 being set in position on the confined end 26 of the casing before the operation of rolling its end edge. The component 25 which in this case is of PE like the dome 2 comprises a base 27 which bears against the shoulder 26 of the casing 11, an upper portion 28 which will be crimped as represented by the rolling of the upper end edge of the casing and one or more surfaces, in this case the two surfaces 29 and 30, which come into contact with the external skirt 31 of the dome 2. The operations of setting in position the component 25, the rolled edge 16 and the dome 2 having been carried out, the sealing fixing operation is effected by rotational welding of the annular surfaces 29 and 30 to the annular portion 31 of the dome 2. The fixing may also be effected by HF induction or ultrasonic welding.

EXAMPLE 4

The external geometry of the preassembled component 101 (see FIG. 8) is the same as that of the component 1 but the reverse surface 32 of its dome 102 was provided with an annular barrier-effect disc or ring member 33 in the operation of moulding the dome 102 onto the skirt 4. The ring member 33 is welded to the dome 102 by way of a large face 34 thereof and is retained at its base by a small annular bead 35 of plastics material. It generally has surface layers of polyolefin which is compatible with the polyolefin of the dome and an intermediate layer of Al or barrier plastics material. In this case the ring member 33 is made from the metalloplastic complex of a thickness of 0.28 mm which was used in the first example.

EXAMPLE 5

The casing 110 in FIG. 9 is of plastics material, in this case HD-PE, of a thickness of 0.6 mm in its cylindrical portion. At its upper end 116 the moulded casing has a tubular portion 111 of rectangular axial section, which is fitted with a clamping action between the internal tubular portion 115 and an annular groove 114 in the dome 112, the tubular portion 111 being applied by way of its horizontal end against the bottom of the groove 114. Fixing is preferably effected by rotational welding but it can also be produced by glueing. The annular horizontal surface 113 and the end of the external lip 117 of the dome 102 may also be involved in that fixing.

EXAMPLE 6

FIG. 10 illustrates the process of the third production procedure. The preassembled component 1 is the same as in the first two examples and fixing of the component 1 to the upper end of the casing 211 with a separate bottom 212, the casing being of tin plate with an external diameter of 47 mm and being 0.3 mm in thickness, is effected in the same way as in the second example, although the skirt 4 is not closed. A cap member 213 is provided to protect the dispensing means 18 and 19 and the filling operation is effected in the inverted position by way of the open end of the skirt 4 which projects from the body of the casing 211. The end of the skirt 4 is then closed, typically by means of one of the methods already described in the second example, the closed end is cropped and it is put back into the body 211 and then the bottom 212 is crimped into position. The dispenser is then pressurized if necessary as already described above.

EXAMPLE 7

FIG. 11 shows a dome 302 of HD-PE which is moulded onto the upper end portion 3 of a metalloplastic skirt 4 identical to the skirt 4 in example 1. In the present case the internal tubular portion 325 of the dome 302 is moulded onto the interior of the end 3 of the skirt 4, the tubular portion 325 being reinforced by a thickening of its upper part which constitutes a part of the periphery of its annular semicircular groove 6 for fixing onto the casing 11.

The flared arrangement of the end 3 around the tubular portion 325 results from the direction of injection of the HD-PE, the injection operation causing the end 3 to bear against the annular moulding tool.

The operation of fixing the dome 302 to the rolled edge of the casing 11 is effected by glueing using the cyanoacrylate glue in the same manner as in example 2. The upper enlarged part 70 of the dome 302 permits fixing of the dispensing means by expanding or flanging over same.

EXAMPLE 8

FIG. 12 shows a dome 312 of polyamide PA 12, the internal tubular portion 335 of which, being 34.3 mm in external diameter, is glued over a height of 12 mm to the interior of a metalloplastic skirt 4 identical to the preceding skirts. That arrangement was the subject of an array of glueing tests concerning domes of different materials:

PA 12 (=Rilsan ®)
PA 6 (=Nylon ®)
HD-PE
Linear PE the domes being glued to the rolled edges at the upper ends of aluminium casings, with families of glues:

a silicone glue "Rhodorseal 5552" (®)
three cyanoacrylate glues:
No 406 Loctite (®)
No 202 Cyanolit (®)
No 208 Cyanolit (®)

The observations made can be summarized as follows: the surfaces of plastics material must preferably be prepared by surface oxidation such as flame treatment or corona effect treatment and aluminium surfaces must preferably be lacquered beforehand, as those glues do not give satisfactory adhesion to bare aluminium. The silicone glue requires pressing times of 1 to 2 minutes and drying times under ambient conditions of more than 24 hours. The three cyanoacrylate glues give similar results: the pressing times can be limited to 5 to 10 seconds and the components can be handled after 30 seconds to 1 minute at ambient temperature. The cyanoacrylate glues are therefore preferable for industrial uses.

In the glueing tests it was observed that the operation of fitting the skirt 4 around the tubular portion 335 of the dome in a properly centered relationship was a delicate one and that sometimes there were deficiencies in respect of the glued connection, corresponding to the glue being excessively scraped off by the end of the skirt 4. Then, after a number of tests, a dome 322 of HD-PE, as shown in FIG. 13, was produced, in which the tubular portion 345, starting from the lower end thereof, comprises: a flexible lip 346 which with the external circular cylindrical surface 347 of the tubular portion 345 defines an annular reserve 348 of a height of 2.5 mm, and then, 5 mm above the lower end, an external frustoconical surface portion 349 with a half cone angle of between 1 and 2; the portion 349 comprising two recessed annular zones 350 and 351 of a depth of 0.06 to 0.08 mm, the zones of unitary heights of 2 mm being connected to each other and to the cylindrical portion 347 by a plurality of recessed bridging portions of a unitary width of 4 mm. The external frustoconical surface 349 is extended to the lower rim 326 of the dome 322 corresponding to the open end of the groove 6 for fixing onto the casing, the rim 326 serves as an abutment and controls the distance with which the skirt 4 is fitted onto the tubular portion around same, fixing it at a height of 14 mm. Taking account of the system for providing reserves of glue as indicated at 348, 350 and 351, the skirt 4 is a slightly clamping fit around the tubular portion 345 and, for an internal skirt diameter of 34.45 mm with a progressive-entry end part 352 on the tubular portion, we have: a diameter for the external cylindrical surface 347 of 34.1 mm, a flexible lip 346 of a thickness of 0.15 to 0.2 mm at its root and an external frustoconical surface 349 which terminates with a diameter of 34.5 mm. Tests with cyanoacrylate glue deposited in advance in the annular reserve 348 gave reproducible results and, according to the tests in respect of detachment of the skirt 4, a reliable sealing effect is obtained at the location of each of the recessed zones 350 and 351.

EXAMPLE 9

This example used a component (dome+skirt) 312 and 4 (see FIG. 14) which was preassembled by glueing (example 8 and FIG. 12) to produce a bag-type dispenser 80 using the process of the first production procedure. In comparison with example 2, there are the following additional differences:

the lower external rim 327 of the dome 312 which borders its annular groove 6 for fixing by glueing onto the rolled edge 16 of the casing 11 which is made of aluminium comprises a small overhanging edge 328 which permits a protective cap (not shown) to be fitted by clipping, and a small skirt or extension portion 329 which masks the fixing of the dome 312 onto the rolled edge 16;

as shown in FIG. 15, the lower end 90 of the skirt 4 was welded in a triangular configuration or more precisely in the form of a triangular star or with three substantially equal arms, prior to the skirt 4 being introduced into the casing 11. The welding operation was effected by means of 3 insulating grippers and an HF induction loop, being a method which produces sufficient flow of the PE to produce a sealing effect at the centre of the star. It is also possible to use ultrasonic welding. That arrangement in the form of three flexible folds which progressively return to the circular cylindrical shape of the top of the skirt 4 permits the bag produced to be introduced in a particularly convenient fashion into the casing of the dispenser. Four folds or more are also possible.

ADVANTAGES

Major advantages have already been referred to at the beginning of the description of the invention.

The tests performed made it possible to demonstrate another advantage which is particularly surprising and attractive from the economic point of view. The use of the dome of plastics material makes it possible to reduce the extent of shaping of the upper end of the casing when using a metal casing. It is then possible substantially to reduce the thickness of the cylindrical portion of the casing, the sole requirement in respect of resistance to internal pressure permitting lateral wall thicknesses which are smaller than with the same requirement in association with the requirement in respect of strength of the heavily shaped dome. That reduction in wall thickness is typically from 20 to 35% relative.

USES

The use of the production process of the invention and the corresponding bag-type dispensers extends to the dispensing of products in the form of aerosols, liquids and creams or gels, in the pharmaceutical, cosmetology, hygiene and foodstuff fields.

We claim:

1. A bag-type dispenser comprising:

a casing including a tubular body and a separate bottom portion;

a tubular skirt;

a dispensing means; and a one-piece molded annular dome of plastics material including an upper annular portion fixed to said dispensing means, a lower tubular portion directly and sealingly fixed to said tubular skirt at an upper portion of said skirt over a height of 5 to 20 mm, and a lower annular portion outside said lower tubular portion, directly and sealingly fixed to said tubular body at an upper end thereof, whereby said dispenser can be filled with a product by way of a lower end of said tubular skirt which is open, and which can substantially be closed to form a bag.

2. A bag-type dispenser according to claim 1, wherein the casing is formed of metal and said bottom portion is fixable to said body by crimping.

3. A bag-type dispenser comprising:

a tubular skirt portion;

a dispensing means; and a one-piece molded annular dome of plastic material, said annular dome including an upper annular portion fixed to said dispensing means, a lower tubular portion directly and sealingly fixed to said tubular skirt at an upper portion of said skirt over a height of 5 to 20 mm, and a lower annular portion outside said lower tubular portion and adapted to be directly and sealingly fixed to an upper end of a tubular casing, whereby said dispenser can be filled with product by way of a lower end of said tubular skirt which is open, and which can subsequently be closed to form a bag, followed by directly and sealingly fixing said outer annular portion to a tubular casing enclosing the bag.

4. A bag-type dispenser according to claim 1, 2 or 3, wherein the dome is sealingly fixed to the tubular skirt portion by a joint molded with the dome onto said skirt.

5. A bag-type dispenser according to claim 1, 2 or 3, wherein said dispensing means comprises a pump with a zero intake of air, said pump bearing an annular fixing rim which is formed at least externally of plastics material, said dome being molded both onto said tubular skirt portion and around said fixing rim of the pump.

6. A bag-type dispenser according to claim 1, 2 or 3, wherein said tubular skirt is fixed to said lower tubular portion of said dome by glue.

7. A bag-type dispenser according to claim 6, wherein said glued lower tubular portion comprises at least one annular recessed zone of a depth of less than 0.15 mm.

8. A bag-type dispenser according to claim 6, wherein the glue is a cyanoacrylate glue, said annular dome is formed of a plastics material selected from the group consisting of polyamide, polycarbonate and polyacetal, and the interior of said skirt portion is formed of polyethylene.

9. A bag-type dispenser according to claim 1, wherein said tubular casing is of metal and comprises a rolled edge at its upper end, and said lower annular portion of said dome comprises a circular groove of plastics which is fixed to said rolled edge.

10. A bag-type dispenser according to claim 1, wherein said tubular casing is of a plastics material, and comprises an upper tubular section, said lower annular portion of said dome comprising an annular groove that is clamped onto said upper tubular section and fixed to it by rotational welding or by gluing.

11. A bag-type dispenser according to claim 3, additionally comprising a tubular casing adapted to be fixed to said lower annular portion.

* * * * *